US005862826A

United States Patent [19]

Gremont

[11] Patent Number: 5,862,826

[45] Date of Patent: Jan. 26, 1999

[54] CANOPY STRUCTURE

[76] Inventor: Boris Gremont, 7715 Applecross La., Dallas, Tex. 75248

[21] Appl. No.: 279,475

[22] Filed: Jul. 25, 1994

Related U.S. Application Data

[63] Continuation-in-part of Ser. No. 157,231, Nov. 22, 1993, Pat. No. 5,331,992, which is a continuation of Ser. No. 795,846, Nov. 21, 1991, abandoned.

[51] Int. Cl.[6] ..... E04H 15/36

[52] U.S. Cl. ..... 135/124; 135/159; 135/119

[58] Field of Search ..... 135/159, 123, 135/124, 135, 119; 52/296, 298, 295, 736.1, 297, 299, 169.9; 248/357; 256/DIG. 5

[56] References Cited

U.S. PATENT DOCUMENTS

| | | | |
|---|---|---|---|
| 1,632,965 | 6/1927 | Hays | 256/DIG. 5 X |
| 2,818,875 | 1/1958 | Denn | 135/159 |
| 3,052,249 | 2/1962 | Seaman et al. . | |
| 3,105,505 | 10/1963 | Maybee . | |
| 3,119,402 | 1/1964 | Bleick | 135/159 |
| 3,563,502 | 2/1971 | Dayson | 52/298 X |
| 3,630,474 | 12/1971 | Minor | 52/296 X |
| 3,653,169 | 4/1972 | Jenner | 52/296 X |
| 4,079,559 | 3/1978 | Tenbrummeler | 52/296 X |
| 4,404,980 | 9/1983 | Wade . | |
| 4,558,713 | 12/1985 | Hagler et al. | 135/159 |
| 4,827,958 | 5/1989 | Cantwell et al. . | |

FOREIGN PATENT DOCUMENTS

| | | | |
|---|---|---|---|
| 569810 | 2/1959 | Canada . | |
| 4213671 | 8/1992 | Japan | 135/159 |
| 2123870 | 2/1984 | United Kingdom | 135/159 |

OTHER PUBLICATIONS

Carapax Shadeports (PTY) LTD, Brochure No. 1.

Carapax Shadeports (PTY) LTD, "The solution for all your domestic parking problems!", Brochure No. 2.

Carapax Shadeports (PTY) LTD, "Protects your Company assets!", Brochure No. 3.

*Primary Examiner*—Lanna Mai

*Attorney, Agent, or Firm*—David H. Judson

[57] ABSTRACT

The invention describes a canopy structure including a plurality of columns, a cover framework of structural members, and a cover. Each structural member is preferably supported on an upper end of a column using a novel joint assembly.

3 Claims, 4 Drawing Sheets

CANOPY STRUCTURE

This application is a continuation-in-part of prior application Ser. No. 08/157,231, filed Nov. 22, 1993, now U.S. Pat. No. 5,331,992, which application was a continuation of prior copending application Ser. No. 07/795,846, filed Nov. 21, 1991, now abandoned.

TECHNICAL FIELD

The present invention relates generally to building constructions and more specifically to a canopy structure particularly adapted for use, for example, as a vehicle port.

BACKGROUND OF THE INVENTION

Permanent building structures used to provide shaded areas are well-known. Such structures typically include a support framework comprising a plurality of upstanding support columns on which structural members are attached. The structural members are normally a plurality of arched or straight pipes that cross each other at an apex or central point of the structure. A cover, usually formed of a polymeric material such as polyethylene, is supported by the structural members to provide a shaded enclosure. A wire rope is supported in and along the periphery of the cover and is used to retain the cover on the structural members. A plurality of such modular structures are typically placed in a side-by-side and/or back-to-front manner to shade a large area.

While such structures have proven generally useful for their intended purpose, they are often subject to failure during certain weather conditions. In particular, high winds have been known to cause complete structural failure of such building structures, rendering such prior art constructions impractical and costly in many geographic areas. Moreover, the cover material in such prior art constructions is typically not resistant to prolonged exposure to the sun, and the materials used for the cover are not fireproof. A further problem is that such canopy structures of the prior art do not provide enough structural support for the cover when the cover is wet or otherwise weighted due to snow, for example. These conditions also contribute to the poor structural integrity of the prior art structures.

There is thus a need to provide a canopy structure that overcomes these and other problems associated with the prior art.

BRIEF SUMMARY OF THE INVENTION

It is an object of the present invention to provide a canopy structure that is highly resistant to structural failure and weathering.

It is yet another object of the present invention to provide a canopy structure which provides suitable shading for a predetermined area such as a vehicle port. When used in such application, the cover of the canopy structure may be formed of a fire-retardant material to facilitate compliance with governmental regulations.

It is a further object to provide a canopy structure that includes improved safety means over the prior art to enable the structure to withstand high winds and other climatic conditions that might otherwise damage the structure and cause structural failure.

It is still another object to provide an improved canopy structure that includes a cover formed of a material which is highly resistant to weathering and which is also fireproof.

It is a still further object to provide a canopy structure that is simple and inexpensive to install and maintain, and that provides an aesthetically-pleasing image.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
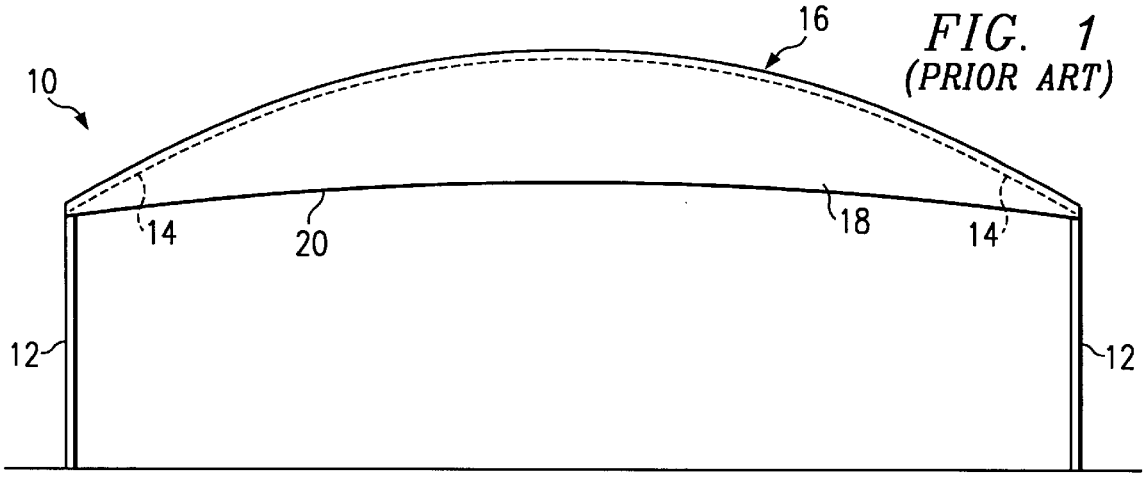
FIG. 1 (PRIOR ART)
FIG. 1 is a front elevation view of a conventional canopy structure of the prior art.
Figure 2:
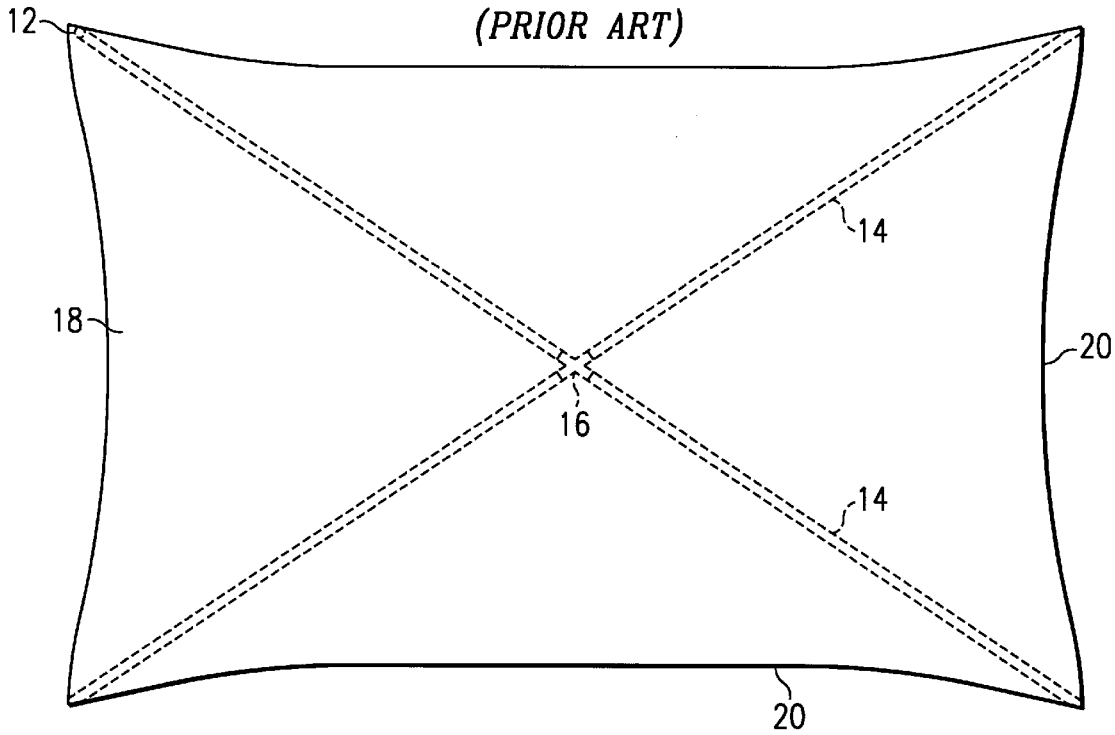
FIG. 2 (PRIOR ART)
FIG. 2 is a plan view of the prior art canopy structure shown in FIG. 1.

Referring now to the drawings, FIG. 1 is a front elevation view of a conventional canopy structure 10 of the prior art. FIG. 2 is a plan view of the prior art canopy structure 10 shown in FIG. 1. The canopy structure 10 comprises a support framework comprising a plurality of upstanding support columns 12 on which structural members 14 are attached. The structural members 14 are normally a plurality of arched members that cross each other at an apex 16 or central point of the structure. A cover 18, usually formed of polyethylene, is supported by the structural members 14 to provide a shaded enclosure. A wire rope 20 or tension cable is supported in and along the periphery of the cover and is used to retain the cover 18 on the structural members 14.

The significant problems associated with the prior art structure of FIGS. 1–2 are overcome by the present invention. The improved canopy structure of the invention is of the same basic construction as shown in FIGS. 1–2 in that each modular unit includes a support framework, a plurality of structural members and an overlying cover; however, many additional features have been added.

Figure 3:
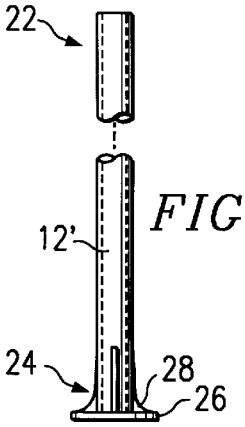
FIG. 3 is an elevational view of the base portion of a column used in the canopy structure of the present invention.
Figure 3A:
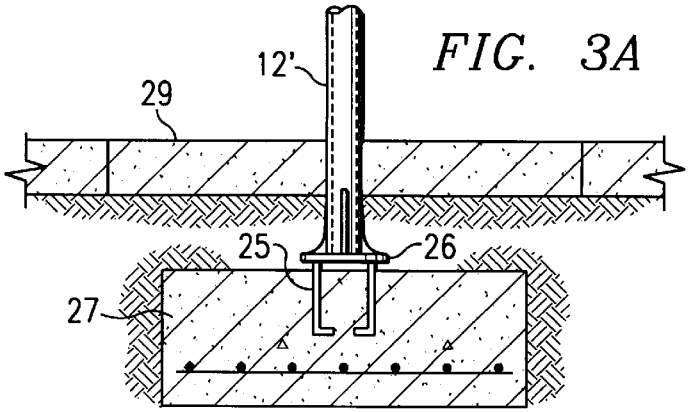
FIG. 3A is a detailed view of the column member of FIG. 3 supported in a concrete footing.

In particular, and with reference now to FIG. 3, each of the support columns 12' of the canopy structure includes an upper end 22 and a lower end 24. The lower end 24 of each upstanding support column 12' includes a flared base 26 having one or more reinforcing ribs 28 for additional structural support against any bending moment. As seen in FIG. 3A, the base 26 of each upstanding support column 12' is secured to a concrete footing 27 in the support surface 29 by one or more concrete anchor bolts 25. Each upstanding support column 12' is preferably hollow such that electrical wiring for a lighting or other electrical system can be drawn up through the column.

Figure 4:
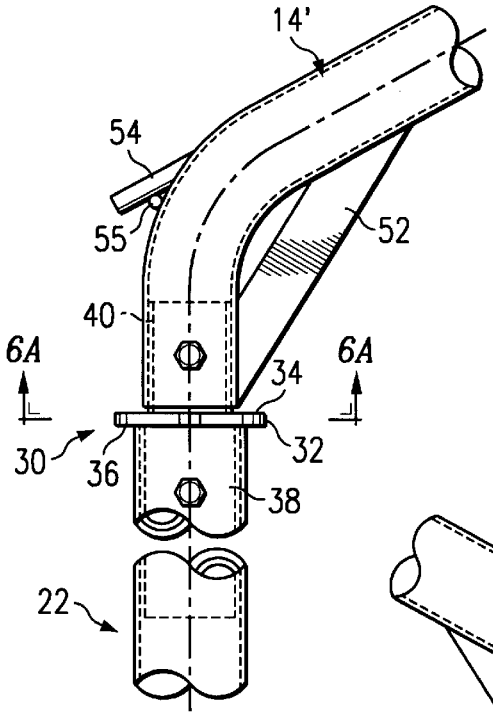
FIG. 4 is a detailed elevation view of an improved joint assembly of the canopy structure of the present invention.
Figure 6A:
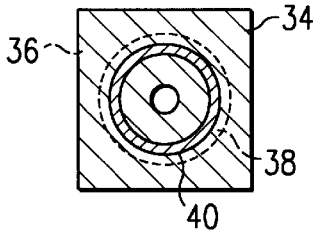
FIG. 6A is a view along lines 6A–6A' of the joint assembly of FIG. 3.
Figure 5:
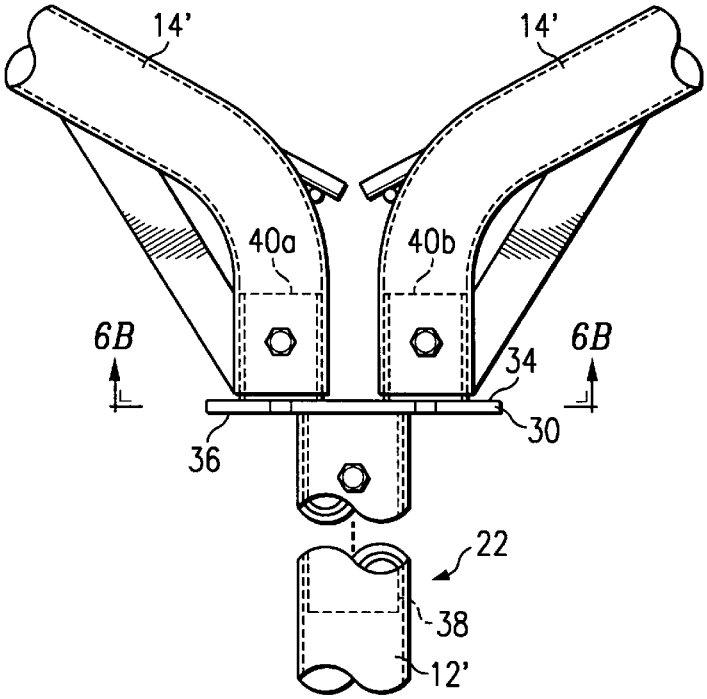
FIG. 5 is a detailed elevation view of another joint assembly of the invention for use with a pair of modular canopy structural units placed in a side-by-side or in a front-to-back manner.
Figure 6B:
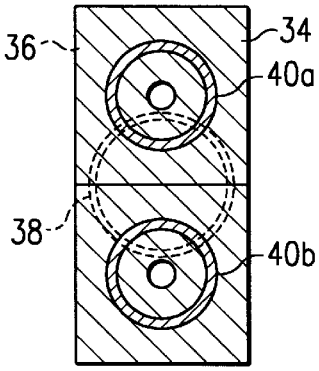
FIG. 6B is a view along line 6B–6B' of the joint assembly of FIG. 4.

Referring now to FIG. 4, a detailed elevation view of an improved joint assembly 30 of the upper frame of the canopy structure is shown. FIG. 6A is a view along lines 6A–6A' of the joint assembly 30 of FIG. 4. The joint assembly 30 of FIG. 4 is used to interconnect each upstanding column member with a structural member used to support the cover of the canopy structure. If a pair of canopy structures are placed side-to-side, then the joint assembly is used to interconnect each upstanding column member with a pair of structural members, with one of the structural members used to support the cover of one canopy structure and the other structural member used to support the cover of the other. This arrangement is shown in FIGS. 5 and 6B. The joint assemblies provide improved structural integrity over the prior art.

Referring now to FIG. 4, for example, the joint assembly 30 comprises a platform 32 having an upper surface 34 and a lower surface 36. A sleeve 38 is rigidly attached to the lower surface 36 of the platform 32 and depends therefrom. The sleeve 38 has an outer diameter slightly less than the inner diameter of the upper end 22 of the upstanding column member 12' such that the sleeve 38 is received in the upper end 22 in a snug manner. The joint assembly 30 also includes a stub 40 rigidly attached to the upper surface 34 of the platform 32.

Figure 7:
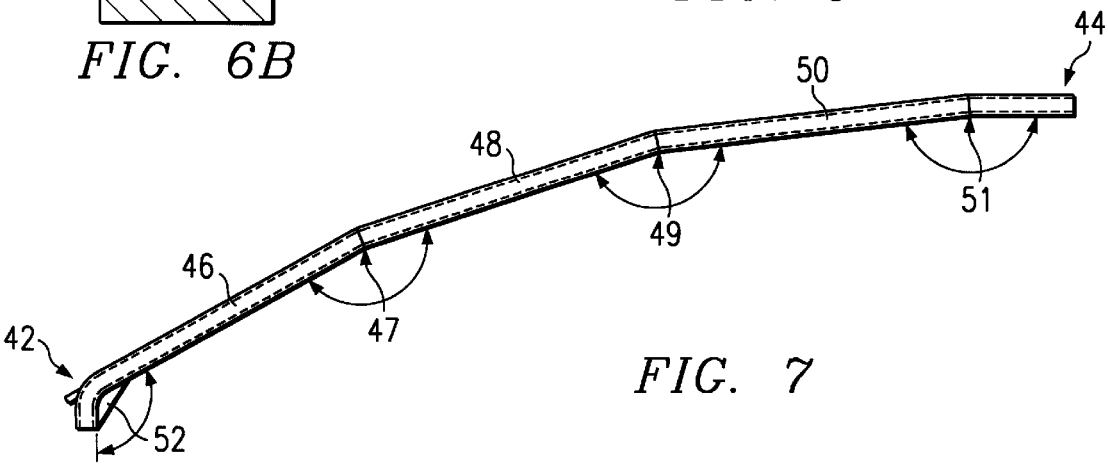
FIG. 7 is an elevation view of a structural member for use in the canopy structure of the present invention.

The structural member 14' is attached to the stub 40. In particular, each of the arched support members 14' has a first end 42 and a second end 44 as best seen in FIG. 7. The arched support member 14' preferably includes a number of intermediate sections 46, 48 and 50. Sections 46 and 48 are joined at angled portion 47; sections 48 and 50 are joined at angled portion 49, and section 50 is joined to second end 44 by angled portion 51. Referring now back to FIG. 4, the first end 42 of each structural member 14' is supported over stub 40 of the joint assembly 30. Each stub has an outer diameter slightly less than the inner diameter of the first end 42 of the structural member 14' such that the stub is snugly received in the first end 42. A gusset member 52 is attached or otherwise welded between the first end 42 and the first intermediate section 46 of the structural member 14' and provides additional rigidity to the joint. A dowel 54 is also attached to or otherwise secured to the outer surface of intermediate section 46 in order to retain the wire tension cable 55.

As described above, if a pair of canopy structures are placed side-to-side, then the joint assembly of FIG. 5 is used to interconnect each upstanding column member with a pair of structural members, with one of the structural members used to support the cover of one canopy structure and the other structural member used to support the cover of the other. As seen in FIGS. 5 and 6B, the joint assembly 30 comprises the platform 32 having an upper surface 34 and a lower surface 36. The sleeve 38 is rigidly attached to the lower surface 36 of the platform 32 and depends therefrom. The sleeve 38 has an outer diameter slightly less than the inner diameter of the upper end 22 of the upstanding column member 12' such that the sleeve 38 is received in the upper end 22 in a snug manner. The joint assembly 30 also includes a pair of stubs 40*a* and 40*b* rigidly attached to the upper surface 34 of the platform 32. Stub 40*a* is used to receive a structural member from one canopy structure while stub 40*b* is used to receive a structural member from an adjacent canopy structure.

Figure 8A:
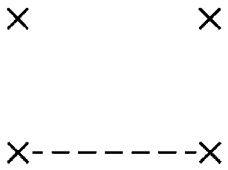
FIG. 8A is a schematic view of a standalone canopy structure.
Figure 8B:
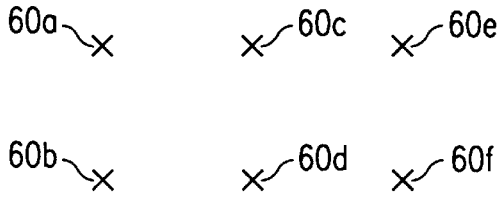
FIG. 8B is a schematic view of a pair of canopy structures supported in a side-by-side relation.

Typically, four (4) upstanding column members 12' are used for a standalone canopy structure. In such a structure, as shown schematically in FIG. 8A, the single joint assembly of FIG. 4 is used. If a pair of canopy structures are required in a side-by-side manner, then typically six (6) column members 60*a*–60*f* are used as shown schematically in FIG. 8B. In this structure, a pair of columns (i.e., columns 60*c*–60*d*) are used as part of each structure through use of the double joint assembly of FIG. 6. The outer columns 60*a*–60*b* and 60*e*–60*f* of each of the two structures each support the single joint assembly of FIG. 4. Of course, larger shade areas can be achieved by adding other modular canopy structure units.

Figure 9:
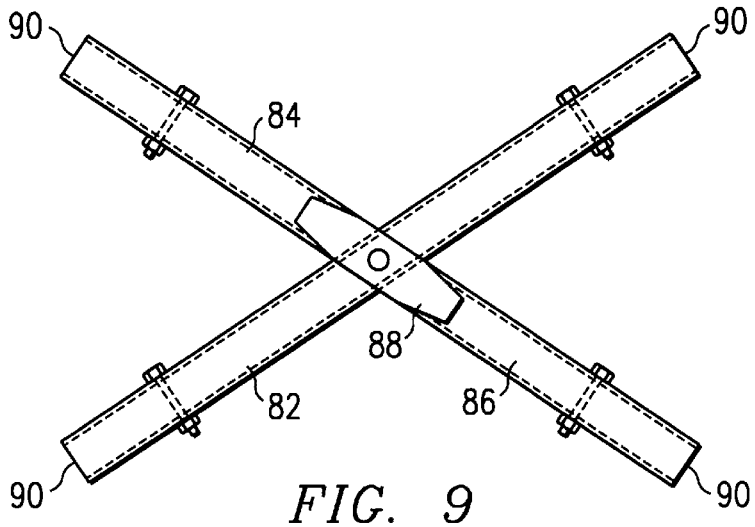
FIG. 9 is a plan view of a structural apex member for use in the canopy structure of the present invention.
Figure 9A:
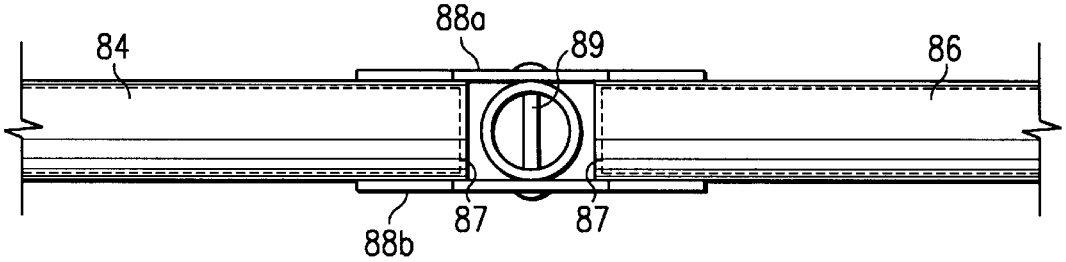
FIG. 9A is a sectional view of the structural apex member of FIG. 9.

Although not meant to be limiting, each canopy structure will preferably include four (4) arched structural members such as shown in FIG. 7. These members are supported in a substantially crossed-manner (as shown in FIG. 2) and interconnected using a structural apex member 80 such as shown in FIG. 9. Apex member 80 comprises beam 82, a pair of beams 84 and 86, and a pair of cover plates 88. As best seen in the sectional view of FIG. 9A, the inner ends 87 of the beams 84 and 86 are welded to the cover plates 88*a* and 88*b* to form an opening through which the beam 82 is received. Fastener 89 is retained in each cover plate to complete the assembly. Each beam 82, 84 and 86 includes an outer opening 90 for receiving a second end of one of the arched structural members. The outer diameter of the second end of each structural member is slightly smaller than the inner diameter of each opening 90 in the apex member 80 to enable each structural member second end to be snugly received in one of the openings 90 of the apex member 80. With this construction, rain water or other moisture is prevented from entering into any of the structural elements.

The canopy structure of the invention also includes the cover. While not meant to be limiting, preferably the cover is formed of a polypropylene with a vinyl cover. Specifically, the material is a 2:1 plain weave vinyl-coated polyester yarn fabric membrane with a minimum tensile strength of 245 pounds and a minimum trapezoidal tearing strength of 50 pounds. This type of material is sold commercially under the trademark TEXTILENE™. Such material is highly resistant to ultraviolet radiation, and is crackproof and fireproof.

Although not meant to be limiting, the wire tension cable 55 used to secure the cover is preferably of 5/16" nominal diameter, 7 strand, 7 wires per strand, with a minimum nominal tensile strength of 9000 pounds. The ends of the cable are secured with a conventional turnbuckle mechanism that allows the tension of the cable to be adjusted.

Figure 10:
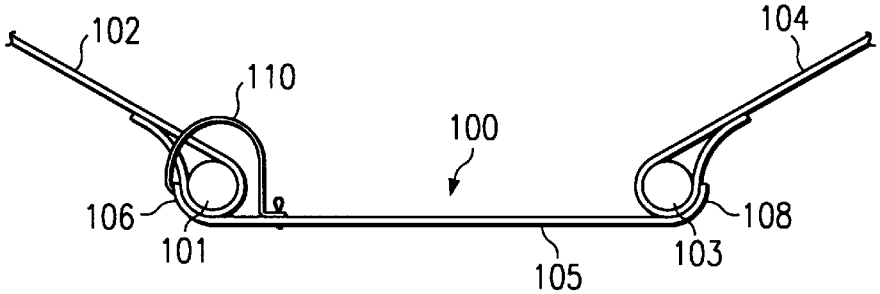
FIG. 10 is an elevational view of a preferred safety clip mechanism for use in the present invention when a pair of modular units are placed in a side-by-side manner.

Referring now to FIG. 10, an elevational view of a preferred safety clip mechanism 100 for use in the present invention when a pair of modular units are placed in a side-by-side manner. One of the units has a tension cable 101 drawn through the peripheral portion of the cover 102 while the other unit has the tension cable 103 drawn through the cover 104. The safety clip mechanism 100 comprises a pressure-release clip 105 having a first end 106 and a second end 108, and a tether 110. First end 106 is secured to the cover 102 around the cable 101. Second end 108 is secured to the cover 104 around the cable 103. Typically, a plurality of such clips are placed along the longitudinal extent of the units. When cover 104 is weighted down by ice or the like, the pressure-release clip snaps open to relieve the pressure and allow the cover to flex. However, the tether 110 insures that the clip is retained in the structure.

The above-described structure of the canopy framework provides significant advantages over the prior art. Each of the joints between the structural and column members is formed in such a way so as to substantially prevent water or other moisture from entering the interior region of any structural member. The hollow interior of each structural and column member is thus maintained dry to prevent degradation of the framework by rusting or other chemical processes. Moreover, by sealing off the interior of each structural and column member from water, the hollow interior of each member can safely support electrical wiring for lighting or other electrical systems associated with the canopy structure.

Moreover, each joint assembly of the framework substantially reduces the significant stress normally associated with prior art systems in which the structural members for the cover are directly attached to the upper ends of the upstanding supports. In particular, the stub(s) and the lower sleeve of the joint assembly is formed of a high tensile strength steel and is adapted to be received within the end of either the upstanding support column or the first end of one of the arched support members. This assembly provides increased structural integrity at the most critical point of the structure. The joints between the structural members substantially prevents water from entering into any of the structural members.

Figure 11:
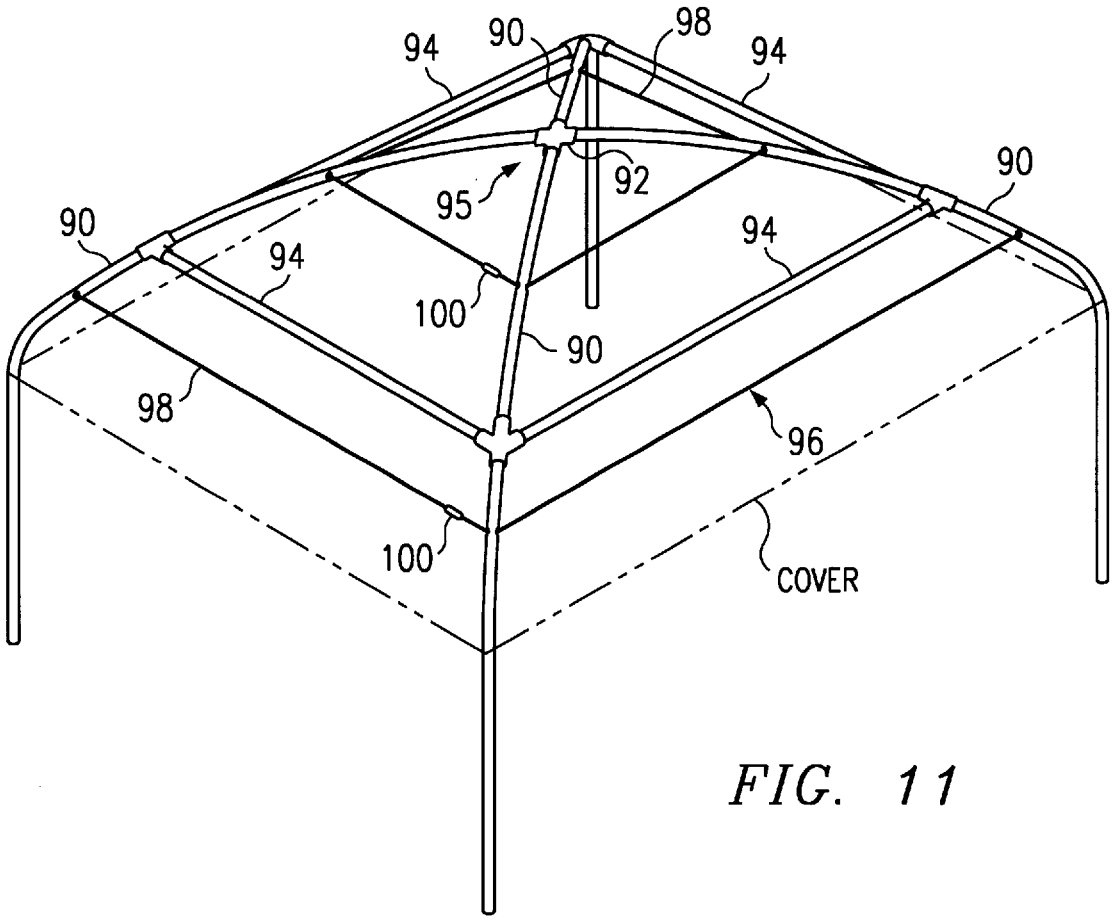
FIG. 11 is a view of an alternate embodiment of the invention wherein an apex structure includes reinforced cross-bracing for improved snow and ice load protection.

FIG. 11 shows an alternate apex structure for providing snow or ice load protection for the unit. In this embodiment a four columned unit includes a cover framework terminating in the four structural members 90, each of which is received in the apex structural member 92 such as described and illustrated in FIG. 8. To provide enhanced load protection, a bracing structure is provided for reinforcement in the apex of the unit. In particular, cross bars 94 are welded between each adjacent pair of structural members to form a "square" substantially as shown. First and second tensioner units 95 and 96 are provided adjacent the apex and below the cross bar "square", respectively. Each tensioner unit comprises a tension wire 98 supported in circular grommets secured to the structural members, and an adjustable tensioner device 100. If desired, the apex assembly may use just one or more of the cross bars 94, or just one of the tensioner units. This structure has been found to provide up to 30 pounds/square foot of load protection for the upper portion of the unit.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A canopy structure comprising a plurality of upright members, a cover framework supported on the plurality of upright members and including a plurality of structural members each having an outer end joined at an apex structural member, a cover supported over the cover framework, and means for tightly securing the cover over the cover framework, wherein the apex structural member comprises a first cross beam, first and second connecting beams each located in an angled relationship to the first cross beam and having an inner end, the first and second connecting beams attached to each other and to the first cross beam by at least one cover plate rigidly securing the first cross beam and the first and second connecting beams, wherein each of the cross beam and the first and second connecting beams include outer ends into which a structural member outer end is received.

2. The canopy structure as described in claim 1 herein the inner ends of each of the first and second connecting beams are sealed to prevent moisture from entering into the connecting beams.

3. A canopy structure comprising a plurality of upright members, a cover framework supported on the plurality of upright members and including a plurality of structural members joined at an apex, a cover supported over the cover framework, tension means including a cable for tightly securing the cover over the cover framework, and a joint assembly between an upper end of an upright member and an angled end of one of the structural members, and a dowel supported on the angled end of the structural member for retaining the cable.

* * * * *